US006583100B2

(12) United States Patent
Song

(10) Patent No.: US 6,583,100 B2
(45) Date of Patent: Jun. 24, 2003

(54) METHOD FOR INCREASING THE SPECIFIC GRAVITY OF LOW PH TRANSPARENT OR TRANSLUCENT, LIQUID OR GEL TYPE DETERGENT PRODUCT WITHOUT AFFECTING TRANSLUSCENCY

(75) Inventor: Brian Xiaoqing Song, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/122,893

(22) Filed: Apr. 15, 2002

(65) Prior Publication Data

US 2002/0183231 A1 Dec. 5, 2002

Related U.S. Application Data

(63) Continuation of application No. PCT/US00/28550, filed on Oct. 13, 2000.

(60) Provisional application No. 60/159,712, filed on Oct. 15, 1999.

(51) Int. Cl.[7] ..... C11D 17/00

(52) U.S. Cl. ..... 510/403; 510/405

(58) Field of Search ..... 510/403, 405

(56) References Cited

U.S. PATENT DOCUMENTS 4,493,786 A * 1/1985 Joshi ..... 252/368
4,762,642 A * 8/1988 Joshi et al. ..... 252/368
5,413,727 A * 5/1995 Drapier et al. ..... 252/97

FOREIGN PATENT DOCUMENTS

WO WO 01/02531 * 1/2001
WO WO 01/29171 * 4/2001

* cited by examiner

*Primary Examiner*—Yogendra N. Gupta
*Assistant Examiner*—John M. Petruncio
(74) *Attorney, Agent, or Firm*—Kevin L. Waugh

(57) ABSTRACT

A method of increasing specific gravity of a liquid or gel type detergent product having a pH less than about 10.0, while at the same time imparting transparency or translucency to said liquid or gel type detergent product, comprises the steps of: (a) providing a liquid or gel type detergent composition having no greater than 20% by weight of (i) potassium tripolyphosphate and (ii) mixed sodium and potassium tripolyphosphate; (b) maintaining a potassium-:sodium weight ratio greater than at least about 0.5:1; and (c) adding one or more of potassium salts, ammonium salts and mixtures thereof, in an amount of at least 5% by weight of the detergent product.

23 Claims, No Drawings

METHOD FOR INCREASING THE SPECIFIC GRAVITY OF LOW PH TRANSPARENT OR TRANSLUCENT, LIQUID OR GEL TYPE DETERGENT PRODUCT WITHOUT AFFECTING TRANSLUSCENCY

CROSS-REFERENCE

This is a continuation of International Application PCT/US00/28550, filed Oct. 13, 2000, which claims the benefit of U.S. Provisional Application 60/159,712, filed Oct. 15, 1999.

TECHNICAL FIELD

The present invention relates to liquid or gel type detergent compositions. More particularly, the invention relates to a method for increasing the specific gravity of transparent or translucent a liquid or gel type detergent product which has a pH less than about 10.0, and a transparent or translucent a liquid or gel type detergent product having a pH less than about 10, and a combination of (a) one or more of potassium and ammonium salts and (b) one or more potassium sources to maintain pre-selected potassium:sodium ratios in order to make the composition transparent or translucent while at the same time not using any (i) potassium tripolyphosphate or (ii) mixed sodium and potassium tripolyphosphate, for enhanced specific gravity, while maintaining the degree of transparency or transluscency.

BACKGROUND OF THE INVENTION

Improving the aesthetics of a low pH (less than about 10, and preferably less than about 9.0) liquid or gel type detergent product (liquid/gel ADW or liqui-gel ADW) is believed to be a very important aspect of this product.

Consumers of liquid ADW products have a preference for liquid ADW products having transparent or translucent characteristics. A transparent or translucent product allows for suspension of colored prills into that product, which can further enhance the physical appearance of the product. The transparent product may be clear, or dyed, using dyes that do not cause significant staining or dyeing of plastics during the wash cycle in automatic dishwashing.

Consumers also have a preference for liquid ADW products that are heavier, i.e., ones that have increased specific gravity. Typically, an increase in specific gravity from about 1.2 grams/ml to about 1.3 grams/ml is deemed to be a significant increase that is appreciated and liked by consumers.

In the low-free water environment of a typical phosphate containing gel type ADW composition, it is a real challenge to obtain clear or translucent characteristics. This is primarily due to the relatively low solubility of commodity phosphate builders, such as sodium tripolyphosphate (STPP), which has a solubility typically of about 14.5 grams per 100 cc of water at room temperature. Previous formulators wishing to obtain clear or translucent characteristics in a liquid or gel type ADW have been forced to use highly soluble potassium tripolyphosphate (KTPP), or alternatively, commercially available mixed sodium and potassium tripolyphosphates (commonly referred to as SKTPP) which have heretofore served a dual purpose of being a potassium source (for transparency/translucency) and a phosphate source (for cleaning performance). The use of KTPP and SKTPP is generally considered undesirable for various reasons, one of them being the economics of manufacturing. Alternatively, the previous formulators have been forced to use very low levels of KTPPs or SKTPs, which detrimentally affects cleaning performance. Thus, a considerable effort has been directed in this field, to develop novel solutions for attaining transparency and/or translucency in liqui-gel ADWs.

For high pH detergent formulations, KOH is the usual potassium source, for not only increasing the specific gravity of the product but also for increasing the alkalinity. However for low pH (less than 10 pH and preferably no more than about 9 pH), the use of KOH in large amounts as a potassium source is undesirable.

There has been an effort directed towards increasing the specific gravity of the liquid product. However, the main drawback is that the present methods employed for increasing specific gravity cause the liquid formulation to lose its transparency, and consequently, this takes away from the product's aesthetic appeal.

It has been desirable to have liqui-gel ADW products that have a specific gravity closer to a value of 1.3 grams/ml rather than 1.2 grams/ml from an aesthetics standpoint. It has been desirable to have a liqui-gel ADW product having transparency and/or translucency characteristics, but with using no more than 20% by weight, preferably no more than 5% by weight and most preferably 0% by weight (i) potassium tripolyphosphate (KTPP), and/or (ii) commercially available mixed sodium and potassium tripolyphosphate (SKTPP), while at the same time still maintaining high phosphate levels so as to not detrimentally affect cleaning performance.

The inventors of the present invention have discovered that the addition of potassium and ammonium salts in an amount of at least 5% by weight of the detergent composition, serves to increase the specific gravity such that it is aesthetically pleasing which providing a potassium source for transluscency. The inventors of the present invention have also discovered that by maintaining a K:Na weight ratio greater than at least about 0.5:1, K:Na, outstanding translucent characteristics can be imparted without having to use KTPP or SKTPP. Thus, high phosphate levels can be attained by the addition of sodium tripolyphosphate (STPP) alone, along with the addition of potassium salts for low to moderate alkalinity.

The present invention is thus directed to overcome one or more of the problems as set forth before.

SUMMARY OF THE INVENTION

The invention meets the needs above by providing a method of increasing specific gravity of a liquid or gel type detergent product which has a pH less than about 10, while at the same time imparting transparency or translucency to said liquid or gel type detergent product, and a transparent or translucent a liquid or gel type detergent product having a pH less than about 10 and a specific gravity of at least about 1.2 grams/ml.

In one aspect of the present invention, the method of increasing specific gravity of a liquid or gel type detergent product having a pH less than about 10.0, while at the same time imparting transparency or translucency to said liquid or gel type detergent product, comprises the steps of: (a) providing a liquid or gel type detergent composition having no greater than 20% by weight of (i) potassium tripolyphosphate and (ii) mixed sodium and potassium tripolyphosphate; (b) maintaining a potassium:sodium weight ratio greater than at least about 0.5:1; and (c) adding one or more of potassium salts, ammonium salts and mixtures thereof, in an amount of at least 5% by weight of the detergent product.

In another aspect of the present invention, a transparent or translucent a liquid or gel type detergent product having a specific gravity greater than about 1.2 grams/ml and a pH less than about 10.0, comprises: (a) a liquid or gel type detergent composition, the composition having no greater than 20% by weight of (i) potassium tripolyphosphate and (ii) mixed sodium and potassium tripolyphosphate; (b) a potassium:sodium weight ratio greater than at least about 0.5:1; and (c) one or more of potassium salts, ammonium salts and mixtures thereof, in an amount of at least 5% by weight of said detergent composition.

DETAILED DESCRIPTION OF THE INVENTION

In the preferred embodiment of the present invention, method of increasing specific gravity of a liquid or gel type detergent product having a pH less than about 10.0, while at the same time imparting transparency or translucency to said liquid or gel type detergent product, comprises the steps of: (a) providing a liquid or gel type detergent composition having no greater than 20% by weight of (i) potassium tripolyphosphate and (ii) mixed sodium and potassium tripolyphosphate; (b) maintaining a potassium:sodium weight ratio greater than at least about 0.5:1; and (c) adding one or more of potassium salts, ammonium salts and mixtures thereof, in an amount of at least 5% by weight of the detergent product.

Limitation of or Express Exclusion of KTPP and SKTPP

In the preferred embodiment, the liquid or gel type detergent composition desirably contains no more than 20%, preferably no more than 5% and most preferably no more than 0% of KTPP and SKTPP. The abbreviation KTPP as used herein means potassium tripolyphosphate, as is commercially available, which may contain incidental and/or trace impurities of other tripolyphosphates, such as STPP. The abbreviation SKTPP, as used herein means commercially available mixed sodium and potassium tripolyphosphates (SKTPP) wherein the weight ratio of Na:K is more than 95:5.

Potassium Salts

The process further includes the step of adding one or more of potassium sources to the liquid or gel type detergent composition, the potassium sources having no more than 20%, preferably no more than 5% and most preferably, no more than 0% by weight potassium tripolyphosphate. In the preferred embodiment of the present invention, the potassium source is potassium sulphate formed in situ in the composition by adding KOH and sulphuric acid. The amount of potassium sulphate is maintained in an amount desirably in a range of from about 5% to about 20% by weight of the detergent composition and preferably in a range of from about 8% to about 15% by weight of the detergent composition. The liquid or gel type detergent composition has a pH desirably less than about 10, preferably less than about pH 9.

Calculation of pH

For purposes of this disclosure, the term pH, as used herein means pH of a 1% solution of liquid ADW composition in water by weight.

Potassium and Ammonium Salts

The potassium salts are selected from the group consisting of $K_2SO_4$, $KNO_3$, $K_2CO_3$, KCl, KBr, $K_3PO_4$, potassium silicate, potassium acetate, or mixtures thereof. When the potassium salt is selected from the aforementioned group, it is added in an amount desirably in a range of from about 2% to about 20% by weight of the detergent composition and preferably in a range of from about 5% to about 16% by weight of the detergent composition, depending upon the availability of K in the potassium source on a molar basis. When the potassium source is selected from the aforementioned group, the liquid or gel type detergent composition has a pH of at least about 6.5. The lower pH values are preferred when formulating the detergent composition with enzymes, which may be present in the liqui-gel composition in a liquid form or in the form of solid prills that are coated with a permeable or impermeable coating. The preferred salt is $K_2SO_4$. The preferred pH is less than about 10.

K:Na Weight Ratio

The process further includes the step of maintaining a potassium:sodium weight ratio desirably greater than about 0.5:1, and preferably above 0.65:1. In a more preferred embodiment, the K:Na weight ratio is desirably maintained in a range of from about 0.5:1 to about 1.25:1, particularly when the detergent composition has a total solids content of less than about 20% by weight. Preferably, the potassium: sodium weight ratio is maintained at least greater than 0.75:1, and more preferably, in a range of from about 0.75:1 to about 2:1, potassium:sodium, particularly when the liquid or gel type detergent composition has a total solids content in a range of from about 20% to about 40% by weight. The total solids content comprises solids in the form of STPP, i.e., the phosphate builder, which is typically present in an amount in a range of about 10% to 40%, thickener, such as a polymer, and potassium hydroxide, i.e., one of the potassium sources. It should be noted that other optional ingredients may also make up the total solids content in a liqui-gel ADW composition.

Specific Gravity

In the preferred embodiment, the specific gravity of the detergent product is at least 1.23, preferably, at least 1.25, and most preferably, greater than 1.28. In one embodiment, the specific gravity of the detergent product is at least 1.25, the product is transluscent, and the pH is less than about 9.0.

Phosphate Builder

The liquid or gel type detergent composition provided in this process, further includes a phosphate builder in an amount desirably in a range of from about 10% to about 40% of said detergent composition, and preferably in a range of from about 12% to about 30% of said detergent composition. The preferred phosphate builder useful in practicing this invention is sodium tripolyphosphate (STPP). The STPP is essentially free of any KTPP, other than what may be present in trace quantities as naturally occurring impurity or an impurity during the commercial manufacturing of STPP. Other phosphate builders known to those skilled in the art may also be utilized in lieu of or in conjunction with STPP.

Other Ingredients (a) Thickeners

The physical stability of the liquid product may be improved and the thickness of the liquid product may be altered by the addition of a cross linking polyacrylate thickener to the liquid detergent product as a thixotropic thickener.

(b) pH Adjusting Components

The above liquid detergent product is preferably low foaming, readily soluble in the washing medium and most effective at pH values best conducive to improved cleaning performance, such as in a range of desirably from about pH 6.5 to about pH 12.5, and preferably from about pH 8.0 to about pH 12.0, more preferably from about pH 8.5 to about pH 12.5. The pH adjusting components are desirably selected from sodium or potassium hydroxide, sodium or potassium carbonate or sesquicarbonate, sodium or potassium silicate, boric acid, sodium or potassium bicarbonate, sodium or potassium borate, and mixtures thereof. NaOH or KOH are the preferred ingredients for increasing the pH to within the above ranges. Other preferred pH adjusting ingredients are sodium carbonate, potassium carbonate, and mixtures thereof.

(c) Low Foaming Surfactant

The liquid nonionic surfactant detergents that can be used to practice the present invention are preferably are alkyl ethoxylates in non-chlorine bleach liquid ADW compositions. One example of a nonchlorine bleach stable surfactant is SLF 18® manufactured by BASF Corporation. Alternatively, in chlorine bleach containing liquid ADW compositions, chlorine bleach stable low foaming surfactants are preferred and such surfactants are present in a range of from about 0.1% to about 10% by weight of the liquid composition. Such surfactants are generally known to one skilled in the art and need not be elaborated here, for purposes of brevity. An example of a chlorine bleach stable surfactant is Dowfax® anionic surfactant available from the Dow Chemical Company.

(d) Enzymes

Enzymes are present in the liqui-gel composition in the form of liquid enzymes when the pH of the liquid ADW is less than about 10.0. At pH's greater than about 10.0, enzymes in the form of solid prills that are coated with impermeable or permeable coating may be used. Various types of enzymes are well known to those skilled in the art, such as proteases and amylases, both of which are useful in carrying out this invention.

(e) Other Adjunct Ingredients

The liquid detergent composition may optionally contain up to about 20% of a dispersant polymer selected from the group consisting of polyacrylates and polyacrylate copolymers.

To exemplify an embodiment of the present invention and demonstrate its benefits, Formula B, an embodiment of the present invention having 10% by weight Potassium Sulphate, is compared with Formula A, which has 0% Potassium Sulphate, in Table 1. A comparison of the Specific Gravity and transluscency is shown in Table 2. The pH of both formulas is less than about 10.0.

TABLE 1

| Ingredients (active) | Formula A | Formula B |
|---|---|---|
| SKTP | 16 | 0.0 |
| STPP | 0.0 | 16 |
| $K_2SO_4$ | 0.0 | 10 |
| Boric Acid | 4.0 | 3.0 |
| 1,2 propanediol | 6.0 | 0.5 |
| Sodium sulfite | 0 | 0.1 |
| $CaCl_2.2H_2O$ | 0.037 | 0.037 |
| Non-ionic surfactant | 0.5 | 0.5 |
| Protease (4% active) | 0.5 | 0.5 |
| Amylase (4% active) | 0.27 | 0.27 |
| Polyacrylate thickener | 1.22 | 1.22 |
| Perfume | 0.10 | 0.10 |
| Dye | 0.0016 | 0.0016 |
| Deionized water | BAL | BAL |

TABLE 2

| | Formula A | Formula B |
|---|---|---|
| Specific Gravity | 1.18 | 1.28 |
| Transluscency | Transluscent | Transluscent |

Accordingly, having thus described the invention in detail, it will be obvious to those skilled in the art that various changes may be made without departing from the scope of the invention and the invention is not to be considered limited to what is described in the specification.

What is claimed is:

1. A method of increasing specific gravity of a liquid or gel type detergent product having a pH less than about 10.5, while at the same time imparting transparency or translucency to said liquid or gel type detergent product, comprising the steps of:

providing a liquid or gel type detergent composition having no greater than 20% by weight of (i) potassium tripolyphosphate and (ii) mixed sodium and potassium tripolyphosphate;

maintaining a potassium:sodium weight ratio greater than at least about 0.5:1; and adding one or more potassium salts in an amount of at least 5% by weight of said detergent product.

2. The process according to claim 1, including no greater than 5% by weight of (i) potassium tripolyphosphate and (ii) mixed sodium and potassium tripolyphosphate.

3. The process according to claim 1, wherein said potassium salt is selected from the group consisting of $K_2SO_4$, $KNO_3$, $K_2CO_3$, KCl, KBr, $K_3PO_4$, potassium silicate, potassium acetate, or mixtures thereof.

4. The process according to claim 1, wherein said potassium salt is formed in situ by adding KOH and sulphuric acid to form $K_2SO_4$.

5. The process according to claim 3, wherein said potassium salt is $K_2SO_4$.

6. The process according to claim 5, wherein said $K_2SO_4$ is present in an amount of at least 5% by weight.

7. The process according to claim 5, wherein said liquid or gel type detergent composition has a pH of no more than about 9.0.

8. The process according to claim 1, wherein said liquid or gel type detergent composition includes a phosphate builder in an amount in a range of from about 10% to about 40% of said detergent composition.

9. The process according to claim 1, wherein said potassium:sodium weight ratio is maintained in an amount greater than about 0.65:1.

10. The process according to claim 9, wherein said liquid or gel type detergent composition has a total solids content of less than about 20% by weight.

11. The process according to claim 1, wherein said potassium:sodium weight ratio is maintained in an amount greater than about 0.75:1.

12. The process according to claim 11, wherein said liquid or gel type detergent composition has a total solids content in a range of from about 20% to about 40% by weight.

13. The process according to claim 1, wherein the specific gravity of the detergent product is at least 1.23.

14. The process according to claim 1, wherein the specific gravity of the detergent product is at least 1.25.

15. The process according to claim 1, wherein the specific gravity of the detergent product is at least 1.25, the product is transluscent, and the pH is less than about 9.0.

16. A transparent or translucent liquid or gel type detergent product having a specific gravity greater than about 1.2 grams/ml and a pH less than about 10.0, comprising:

a liquid or gel type detergent composition, said composition having no greater than 20% by weight of (i) potassium tripolyphosphate and (ii) mixed sodium and potassium tripolyphosphate;

a potassium:sodium weight ratio greater than at least about 0.5:1; and one or more potassium salts in an amount of at least 5% by weight of said detergent composition.

17. The product according to claim 16, including no greater than 5% by weight of (i) potassium tripolyphosphate and (ii) mixed sodium and potassium tripolyphosphate.

18. The product according to claim 16, wherein said potassium salt is selected from the group consisting of $K_2SO_4$, $KNO_3$, $K_2CO_3$, KCl, KBr, $K_3PO_4$, potassium silicate, potassium acetate, or mixtures thereof.

19. The product according to claim 16, wherein said potassium salt is formed in situ by adding KOH and sulphuric acid to form $K_2SO_4$.

20. The product according to claim 16, wherein said liquid or gel type detergent composition has a pH of no more than about 9.0.

21. The product according to claim 9, wherein said liquid or gel type detergent composition has a total solids content of less than about 20% by weight.

22. The product according to claim 1, wherein the specific gravity of the detergent product is at least 1.23.

23. The product according to claim 1, wherein the specific gravity of the detergent product is at least 1.25, the product is transluscent, and the pH is less than about 9.0.

* * * * *

UNITED STATES PATENT AND TRADEMARK OFFICE

CERTIFICATE OF CORRECTION

PATENT NO. : 6,583,100 B2 
DATED : June 24, 2003
INVENTOR(S) : Brian Xiaoqing Song It is certified that error appears in the above-identified patent and that said Letters Patent is hereby corrected as shown below:

Title page,
Item [56], References Cited, U.S. PATENT DOCUMENTS, please insert the following: -- 5,213,706 05-25-1993 Rapisarda, et al. --
FOREIGN PATENT DOCUMENTS, please insert the following:
-- EP 0 334 566 A2 09-27-1989
EP 0 479 370 A2 04-08-1992
WO 93/21298 A1 10-28-1993 --

Signed and Sealed this

Twenty-first Day of October, 2003

JAMES E. ROGAN
*Director of the United States Patent and Trademark Office*